US007623672B2

(12) United States Patent
Wu et al.

(10) Patent No.: US 7,623,672 B2
(45) Date of Patent: Nov. 24, 2009

(54) MICROPHONE ARRAY IN HOUSING RECEIVING SOUND VIA GUIDE TUBE

(75) Inventors: Li-Te Wu, Taipei (TW); Wei-Chan Hsu, Cupertino, CA (US)

(73) Assignee: Fortemedia, Inc., Cupertino, CA (US)

( * ) Notice: Subject to any disclaimer, the term of this patent is extended or adjusted under 35 U.S.C. 154(b) by 154 days.

(21) Appl. No.: 11/457,823

(22) Filed: Jul. 17, 2006

(65) Prior Publication Data

US 2008/0013770 A1 Jan. 17, 2008

(51) Int. Cl.
*H04R 9/08* (2006.01)

(52) U.S. Cl. ..... 381/357; 381/356

(58) Field of Classification Search ..... 381/313, 381/322, 323, 324, 350, 356, 357, 358
See application file for complete search history.

(56) References Cited

U.S. PATENT DOCUMENTS 6,151,399 A * 11/2000 Killion et al. ..... 381/356
7,013,014 B2 * 3/2006 Ach-Kowalewski et al. . 381/313
7,151,839 B2 * 12/2006 Niederdrank ..... 381/324
2005/0002541 A1 * 1/2005 Killion et al. ..... 381/353
2007/0127759 A1 * 6/2007 Zhang et al. ..... 381/338

OTHER PUBLICATIONS

PCT search report mailed Apr. 2, 2008.

* cited by examiner

*Primary Examiner*—Brian Ensey
(74) *Attorney, Agent, or Firm*—Thomas, Kayden, Horstemeyer & Risley

(57) ABSTRACT

An electronic device includes a housing, a plurality of microphones, and a plurality of guide tubes. The plurality of microphones are disposed in the housing. The plurality of guide tubes extend from the housing toward the plurality of microphones, whereby the plurality of microphones in the housing are capable of receiving external sound via the guide tubes.

9 Claims, 2 Drawing Sheets

MICROPHONE ARRAY IN HOUSING RECEIVING SOUND VIA GUIDE TUBE

BACKGROUND OF THE INVENTION

1. Field of the Invention

The invention relates to a microphone array in a housing receiving sound via guide tubes.

2. Description of the Related Art

A typical microphone array includes a number of microphones disposed in tandem. A simple example is shown in FIG. 1, wherein the microphone array 10 includes two microphones 11 and 12 placed side by side. Directivities of the microphone array 10 can be achieved by manipulating the signal received by the two microphones 11 and 12. Assuming the two microphones 11 and 12 are omni-directional and having the same characteristics, the directivity of the microphone array 10 depends on vector $d^{\omega}$ from one microphone 11 to the other microphone 12.

The above-mentioned microphones 11 and 12 are placed in open space for achieving the directivity. Most electronic devices (cellular phones, personal digital assistants, etc.), however, have plastic or metal housings, which are acoustic isolators. Acoustic isolators block audio signals increasing difficulty in placing microphones. Furthermore, in modern devices, the majority of electronic elements including microphones are surface-mounted on printed circuit boards (PCBs), thus limiting the directivity of the microphone array. As illustrated by FIG. 2, microphones 11' and 12' are disposed in a housing 20. The housing 20 acts as an acoustic isolator preventing the microphones 11' and 12' from receiving external sound. Furthermore, the distance d1 between the microphones 11' and 12' on the PCB 21 is limited by the available space on the PCB 21 and in the housing 20, and generally is less than the desired distance in design (d1<d). The direction of the microphone array, as designated by vector $\overrightarrow{d1}$, is always parallel to the PCB 21. Such a direction, however, is generally not toward the sound source during operation of the electronic device.

BRIEF SUMMARY OF THE INVENTION

An object of the invention is to locate a microphone array in a housing of an electronic device capable of preventing the described problems.

The electronic device in accordance with an exemplary embodiment of the invention includes a housing, a plurality of microphones, and a plurality of guide tubes. The plurality of microphones are disposed in the housing. The plurality of guide tubes extend from the housing toward the plurality of microphones, whereby the plurality of microphones in the housing are capable of receiving external sound via the guide tubes.

The electronic device may further include a plurality of acoustically isolated chambers disposed in the housing for preventing sound transmission therebetween, wherein the plurality of microphones are disposed in the plurality of chambers in a one-to-one manner.

The housing may have a plurality of holes, and the plurality of guide tubes extend from the plurality of holes to the plurality of chambers.

The plurality of holes may be spaced apart a first distance, and the plurality of microphones are spaced apart a second distance less than the first distance.

The plurality of microphones may include uni-directional microphones, omni-directional microphones, or combinations thereof.

The guide tubes may be equal in length.

The electronic device may further include an acoustic damper, wherein the plurality of guide tubes includes a first guide tube and a second guide tube shorter than the first guide tube, and the acoustic damper is disposed in the second guide tube.

The electronic device may be a cellular phone, an audio recorder, a personal digital assistant (PDA), etc.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
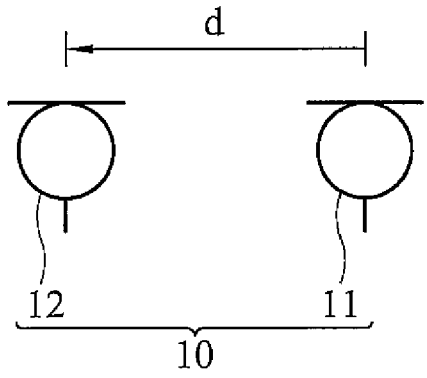
FIG. 1 (RELATED ART)
FIG. 1 is a schematic diagram of a typical microphone array.
Figure 2:
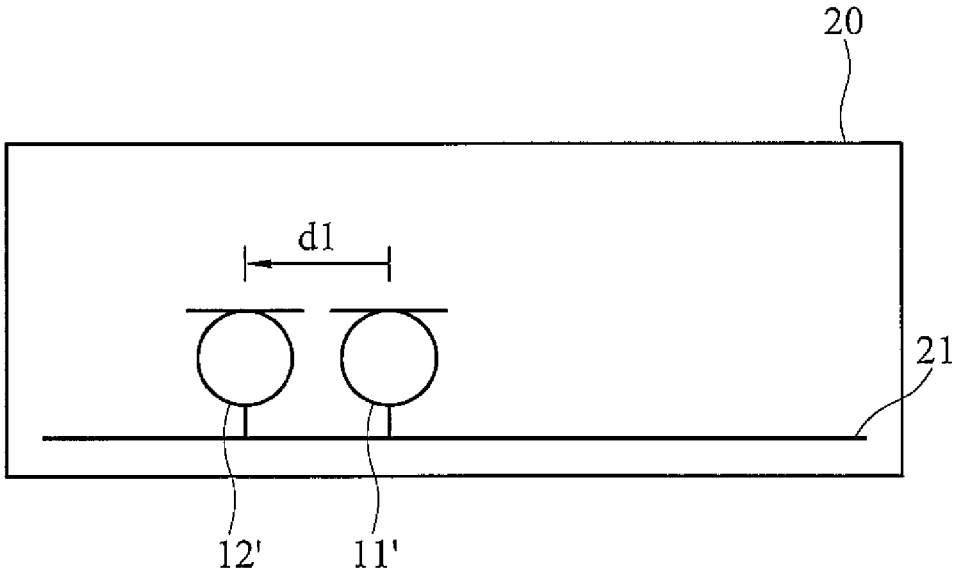
FIG. 2 (RELATED ART)
FIG. 2 is a schematic view showing a microphone array disposed in a housing of an electronic device.
Figure 3:
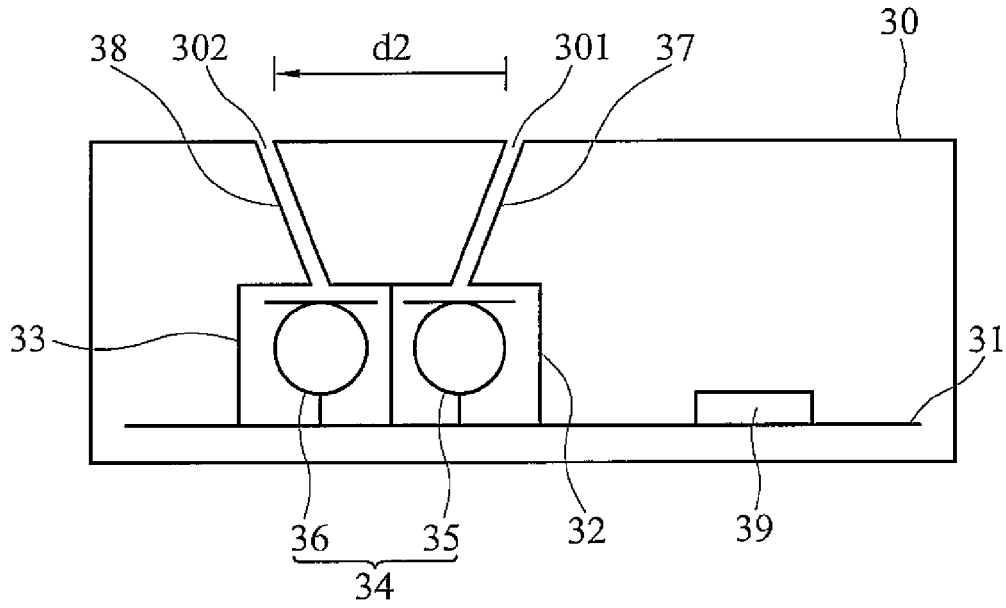
FIG. 3 depicts an electronic device in accordance with an embodiment of the invention.

Referring to FIG. 3, an electronic device in accordance with an embodiment of the invention has a housing 30, a printed circuit board (PCB) 31, a plurality of microphones 35 and 36, a plurality of chambers 32 and 33, a plurality of guide tubes 37 and 38, and an integrated circuit (IC) 39. All of the elements 31, 32, 33, 35, 36, 37, 38 and 39 are disposed in the housing 30.

In this embodiment, the microphones 35 and 36 are omni-directional and disposed in the chambers 32 and 33 in an one-to-one manner. The guide tubes 37 and 38 are equal in length and extend from the chambers 32 and 33 to the openings 301 and 302 of the housing 30. Thus, the microphones 35 and 36 are capable of receiving external sound via the guide tubes 37 and 38. The chambers 32 and 33 are also acoustically isolated from each other to prevent sound transmission therebetween.

The microphones 35, 36 and the IC 39 are surface-mounted on the PCB 31. The microphones 35 and 36 constitute a microphone array 34. The directivity of the microphone array 34 is determined by the openings 301 and 302 rather than the microphones 35 and 36. Such an arrangement is advantageous in achieving the directivity of the microphone array 34 because the openings 301 and 302 can be spaced apart a distance d2 greater than the microphones 35 and 36 as shown in FIG. 3. The IC 39 performs signal conditioning and possible digital signal processing for the electrical signals provided by the microphones 35 and 36.

In this embodiment, the guide tubes 37 and 38 are equal in length, thus, the delay in sound propagating through the guide tubes 37 and 38 is equal. In some cases, however, the lengths of the guide tubes cannot be equal due to design constraints caused by the location of the PCB or the shape of the housing. Thus, a modified embodiment is necessarily provided and described as follows.

Figure 4:
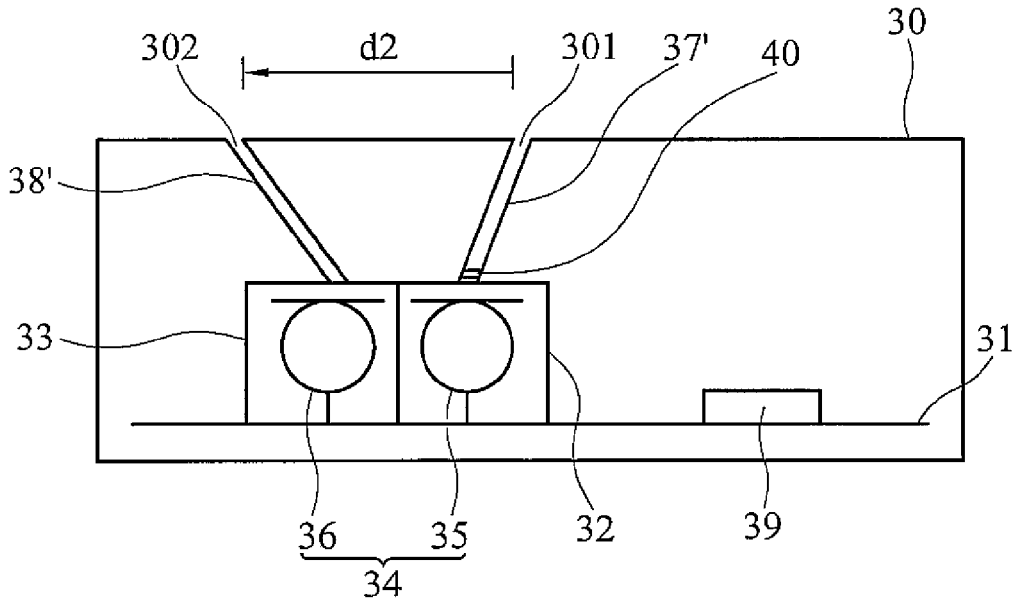
FIG. 4 depicts an electronic device in accordance with another embodiment of the invention.

FIG. 4 depicts an electronic device in accordance with another embodiment of the invention, wherein the guide tubes 37' and 38' are not equal in length. Assuming the guide tube 37' is shorter than the guide tube 38', an acoustic damper 40 is disposed in the shorter guide tube 37'. An acoustic damper is a material that slows down sound propagation. Thus, time for sounds to propagate through the guide tubes 37' and 38' is equal.

In the invention, the guide tubes allow a microphone array to receive external sound. Although the microphone array is disposed in a housing, the quality of audio signals received by the microphone array is not influenced by the housing. Furthermore, the directivity of the microphone array is determined by the openings of the housing rather than the microphones on a PCB. Thus, a design of the directivity of the microphone array in an electronic device for satisfying practical demands is easy and flexible. It is understood that the invention is applicable to a variety of electronic devices including a cellular phone, an audio recorder, a personal digital assistant (PDA), and others.

In the described embodiments, the microphone array is constituted by omni-directional microphones. It is understood, however, that the microphone array can be constituted by uni-directional microphones, omni-directional microphones, or combinations thereof.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone array in an electronic device, comprising:

a housing;

a plurality of microphones disposed in the housing;

a plurality of guide tubes extending from the housing toward the plurality of microphones; and a plurality of chambers disposed in the housing and acoustically isolated from each other to prevent sound transmission therebetween, wherein the plurality of microphones are disposed in the plurality of chambers in a one-to-one manner.

2. The microphone array as claimed in claim 1, wherein the housing has a plurality of holes, and the plurality of guide tubes extend from the plurality of holes to the plurality of chambers.

3. The microphone array as claimed in claim 2, wherein the plurality of holes are spaced apart a first distance, and the plurality of microphones are spaced apart a second distance less than the first distance.

4. The microphone array as claimed in claim 1, wherein the plurality of microphones comprise uni-directional microphones, omni-directional microphones, or combinations thereof.

5. The microphone array as claimed in claim 1, wherein the guide tubes are equal in length.

6. The microphone array as claimed in claim 1, further comprising an acoustic damper, wherein the plurality of guide tubes includes a first guide tube and a second guide tube shorter than the first guide tube, and the acoustic damper is disposed in the second guide tube.

7. The microphone array as claimed in claim 1, wherein the electronic device is a cellular phone.

8. The microphone array as claimed in claim 1, wherein the electronic device is an audio recorder.

9. The microphone array as claimed in claim 1, wherein the electronic device is a personal digital assistant.

* * * * *